US006328223B1

(12) United States Patent
Holt et al.

(10) Patent No.: US 6,328,223 B1
(45) Date of Patent: Dec. 11, 2001

(54) SINGLE CONTROL PAINT SPRAYER

(75) Inventors: Brian Douglas Holt; Brian Linton Frost, both of Mt. Juliet, TN (US)

(73) Assignee: Campbell Hausfeld/Scott Fetzer Company, Westlake, OH (US)

( * ) Notice: Subject to any disclaimer, the term of this patent is extended or adjusted under 35 U.S.C. 154(b) by 0 days.

(21) Appl. No.: 09/588,455

(22) Filed: Jun. 6, 2000

Related U.S. Application Data

(60) Provisional application No. 60/150,042, filed on Aug. 20, 1999.

(51) Int. Cl.[7] ..... B05B 9/00

(52) U.S. Cl. ..... 239/124; 239/569; 239/581.1; 239/353; 137/560

(58) Field of Search ..... 137/580, 505.11, 137/524, 530, 614.11; 60/468; 239/124, 127, 569, 581.1, 581.2, 526, 527, 528, 353

(56) References Cited

U.S. PATENT DOCUMENTS 3,614,351 * 10/1971 Wojcik ..... 137/560
4,834,287 5/1989 Walsh et al. .
4,928,722 5/1990 Walsh et al. .

* cited by examiner

*Primary Examiner*—David A. Scherbel
*Assistant Examiner*—Christopher S. Kim
(74) *Attorney, Agent, or Firm*—Jones, Day, Reavis & Pogue

(57) ABSTRACT

A paint sprayer having an on/off switch, a bypass valve and a pressure adjusting valve has a single manually rotatable control that operates the switch, the bypass valve and the pressure adjusting valve.

22 Claims, 15 Drawing Sheets

SINGLE CONTROL PAINT SPRAYER

This application claims priority to an earlier filed provisional application Serial No. 60/150,042 filed Aug. 20, 1999.

BACKGROUND OF THE INVENTION

This application relates to the art of controls and, more particularly, to manually operable single controls that perform multiple functions. The invention is particularly applicable for use with airless paint sprayers and will be described with specific reference thereto. However, it will be appreciated that the invention has broader aspects and that certain features of the invention can be used for other purposes.

Airless paint sprayers typically have an on/off switch, a bypass valve for priming and pressure relief, and a pressure adjusting valve for adjusting the pressure at which paint is supplied to the spray gun so that the pressure is suitable for the project at hand.

It is common to have a separate manually operable control for each of the on/off switch, the bypass valve and the pressure adjusting valve. A typically recommended operating procedure advises a user to first move the pressure adjusting control to the low pressure position and the bypass valve control to the open or prime position before the switch is turned on. After the switch is turned on by operating the switch control, the user must move the separate pressure adjusting control to a medium pressure setting and wait for the unit to prime. Once the unit is primed, the user must move the separate bypass valve control to the spray position and move the separate pressure adjusting control to the desired pressure setting before spraying can begin.

In devices of the type described, a user does not know the pressure setting of the pressure adjusting valve unless the sprayer has an attached pressure gauge. In addition, arrangements of the type described permit a user to turn the switch to its off position while leaving the unit at fill pressure. This is undesirable because a user may try to remove a hose or misdirect spray by not realizing that the unit remains under pressure even though it is turned off.

An arrangement has been proposed that will not allow a user to shut the sprayer off while it is under pressure but it includes two separate controls that are arranged to force a user to operate them in a certain order.

It would be desirable to have a simplified control arrangement that operates in a predetermined sequence and avoids problems associated with existing arrangements.

SUMMARY OF THE INVENTION

A paint sprayer of the type described has a single manually operable control that operates the on/off switch, the bypass valve and the pressure adjusting valve. The single control automatically operates the on/off switch, the bypass valve and the pressure adjusting valve in a predetermined proper sequence both when the sprayer is turned on and when it is turned off.

In accordance with a preferred arrangement, the manually operable control is rotatable between opposite end limits or end positions, with one end limit being a switch off position and the opposite end limit being the highest pressure setting with the switch on. In the one end limit position of the control with the switch off, the bypass valve is open. Movement of the control a short distance away from the one end limit position to a priming position turns the switch on while leaving the bypass valve open for priming the unit.

Further movement of the control away from the one end limit position closes the bypass valve while leaving the switch on and allows selective adjustment of the pressure adjusting valve over a range of pressures from the lowest pressure adjacent to the priming position to the highest pressure at the opposite end limit position.

In accordance with one arrangement, the manually operable control includes a rotatable control plate having an arcuate slot therein. An end portion of a valve stem on the bypass valve projects through the slot and has a bypass valve cam follower thereon for cooperation with a bypass cam on the control plate adjacent the slot to open the bypass valve when the control plate is at and adjacent to the one end limit position of the control. The bypass valve opens as the control approaches the switch off position so that the pressure is relieved before the unit is turned off. Obviously, other arrangements are possible for providing cooperative relationship between the manually operable control and the bypass valve.

In accordance with another aspect of the application, the control has a switch cam thereon for cooperation with a switch cam follower to turn the switch on and off. In one arrangement, the cam on the control is a cam recess and the switch cam follower moves into the switch cam recess to open a normally closed switch. In another arrangement, the switch cam on the control is a cam projection that cooperates with the switch cam follower to positively turn the switch off.

In accordance with another aspect of the application, the pressure adjusting valve includes a rotatable adjusting member that rotates with the manually operable control. Rotation of the manually operable control over a range of pressure settings allows adjustment of the pressure adjusting valve to regulate the pressure at which the paint is pumped.

In the arrangement of the present application, the bypass valve always is open to relieve pressure in the unit before the control moves to a position for turning the switch off. Thus, a user cannot turn the sprayer off while leaving it under pressure unless the power is interrupted such as by separation of the power plug from the socket while the switch is on and the sprayer is under pressure.

It a principal object of the present invention to provide an airless paint sprayer with a single manually operable control that operates an on/off switch, a bypass valve and a pressure adjusting valve.

It also is an object of the invention to provide such a control that has a bypass cam and a bypass valve cam follower arrangement for operating the bypass valve and moving same between its open priming and pressure relieving position and its closed position.

It is a further object of the invention to provide such a control wherein the sprayer cannot be turned off while it is under pressure.

It is another object of the invention to provide such a control that enables a user to operate the sprayer in a proper sequence without requiring any conscious effort or decisions.

DESCRIPTION OF A PREFERRED EMBODIMENT

Figure 1:
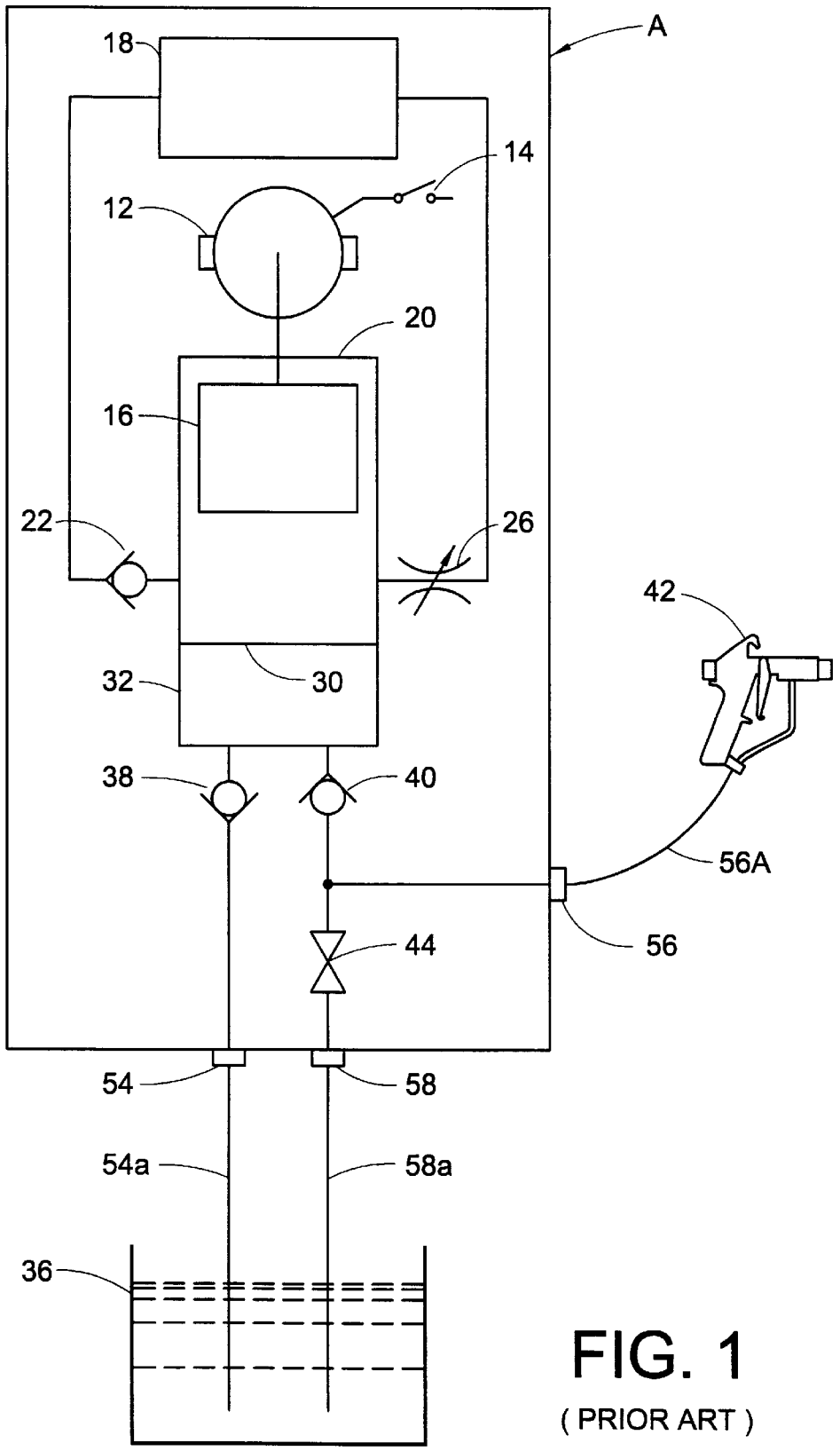
FIG. 1 ( PRIOR ART )
FIG. 1 is a fluid flow schematic of a typical airless paint sprayer.

Referring now to the drawing, wherein the showings are for purposes of illustrating a preferred embodiment of the invention only and not for purposes of limiting same, FIG. 1 shows an airless paint sprayer A having an electric motor 12 that is operated by an on/off switch 14 to reciprocate a pump piston 16. Operation of piston 16 recirculates hydraulic fluid from a hydraulic fluid reservoir 18 through pump chamber 20 past an inlet check valve 22 and a pressure adjusting outlet valve 26.

The pressure in pump chamber 20 acts on paint pump diaphragm 30 to move same toward paint pump chamber 32. A suitable return spring that is not shown normally biases diaphragm 30 in a direction away from paint pump chamber 32 toward pump chamber 20 for the return stroke of the diaphragm. Paint flows into paint pump chamber 32 from a paint bucket 36 through an inlet check valve 38 and flows out of paint pump chamber 32 through an outlet check valve 40. Paint flows from outlet check valve 40 to a spray gun 42 when bypass valve 44 is closed or returns to paint bucket 36 when bypass valve 44 is open.

Once the sprayer is primed, switch 14 remains on, bypass valve 44 is closed, and pressure adjusting valve 26 is adjusted to control the pressure in pump chamber 20 and thereby control the outlet pressure of the paint from paint pump chamber 32.

Figure 2:
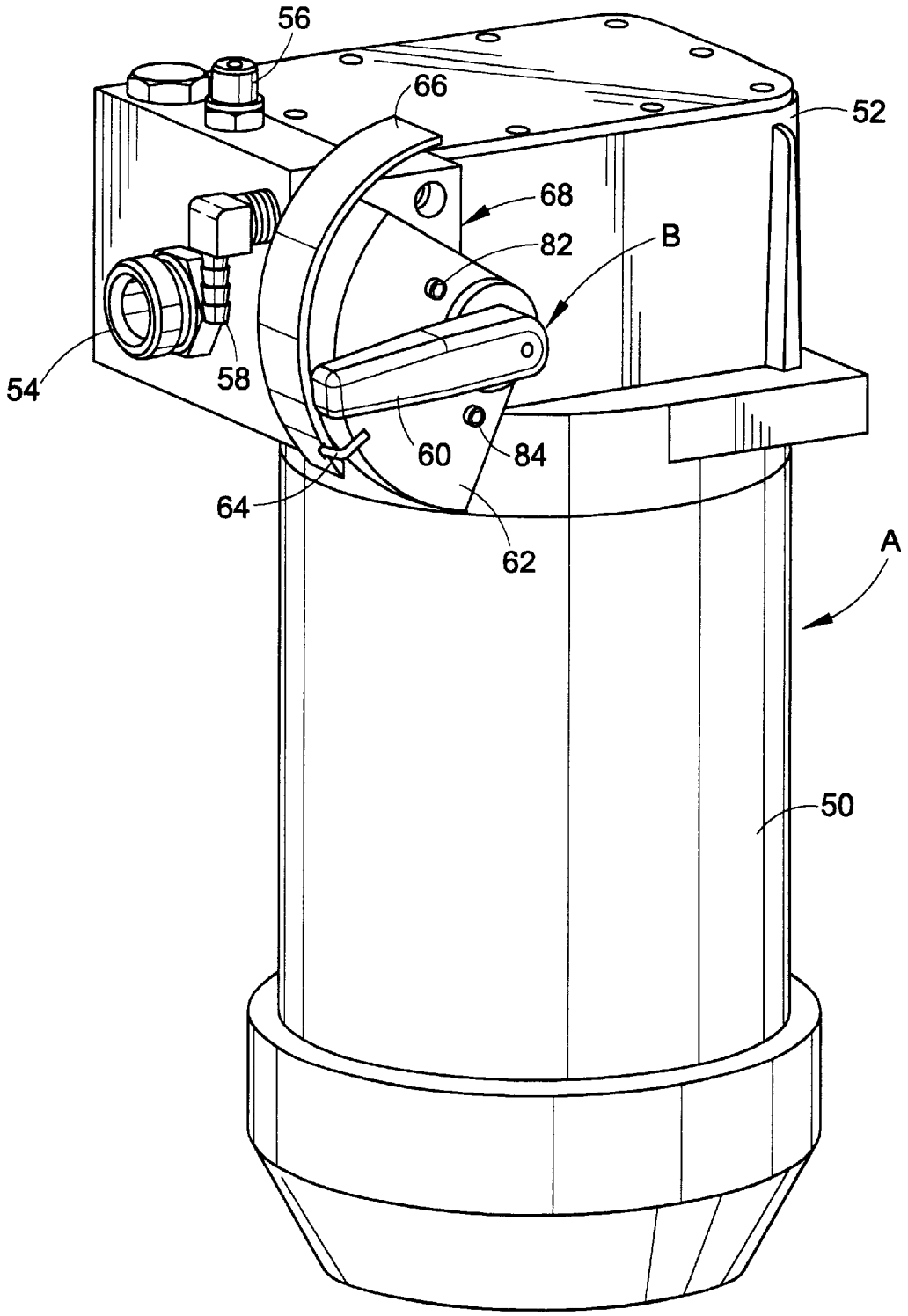
FIG. 2 is a perspective illustration of a paint sprayer having the improvements of the present application incorporated therein.
Figure 3:
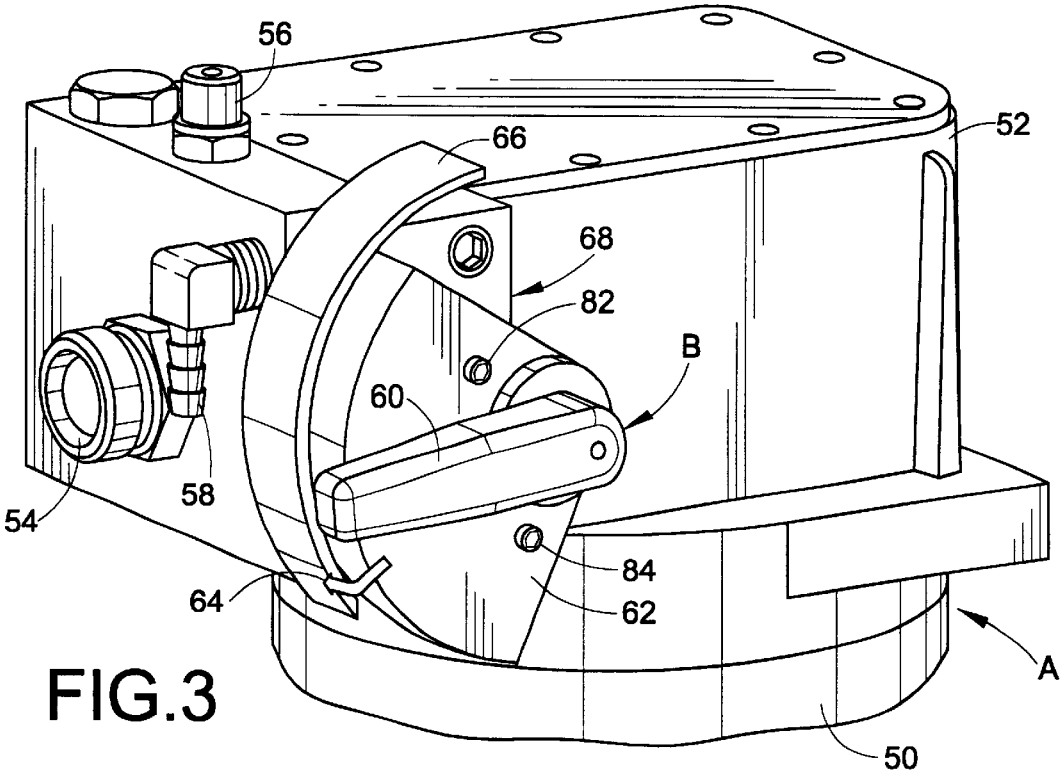
FIG. 3 is a perspective illustration of the upper portion of the paint sprayer of FIG. 2 with the control in its off position.
Figure 4:
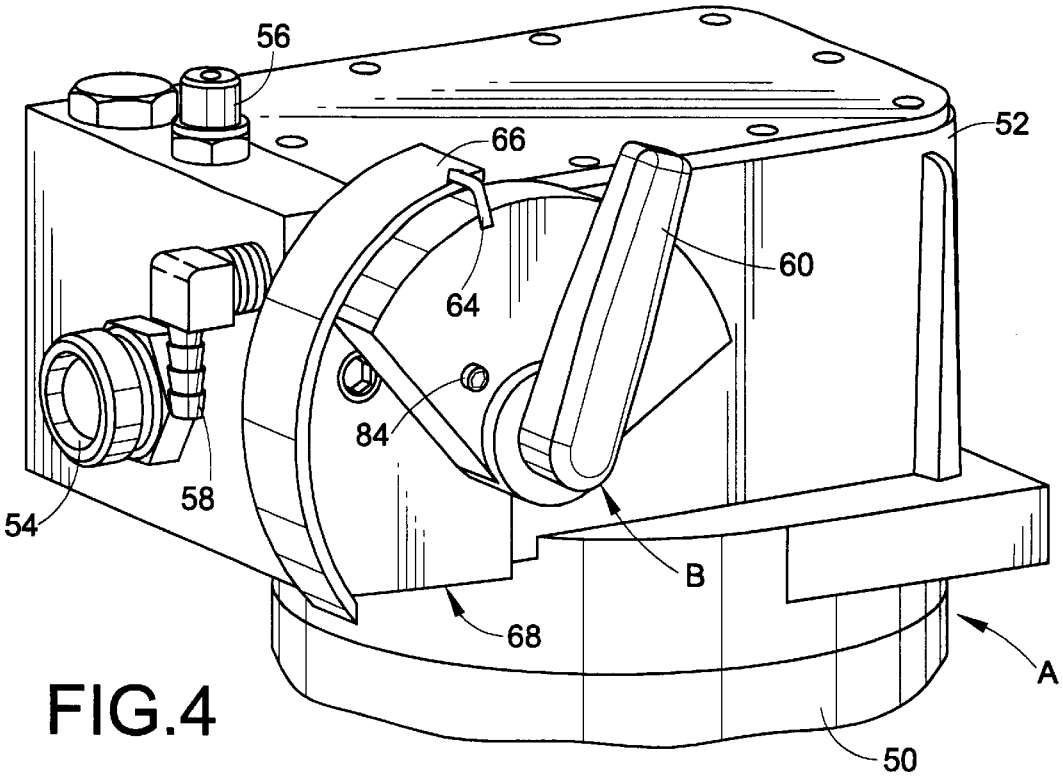
FIG. 4 is a perspective illustration similar to FIG. 3 showing the control in the high pressure position.
Figure 5:
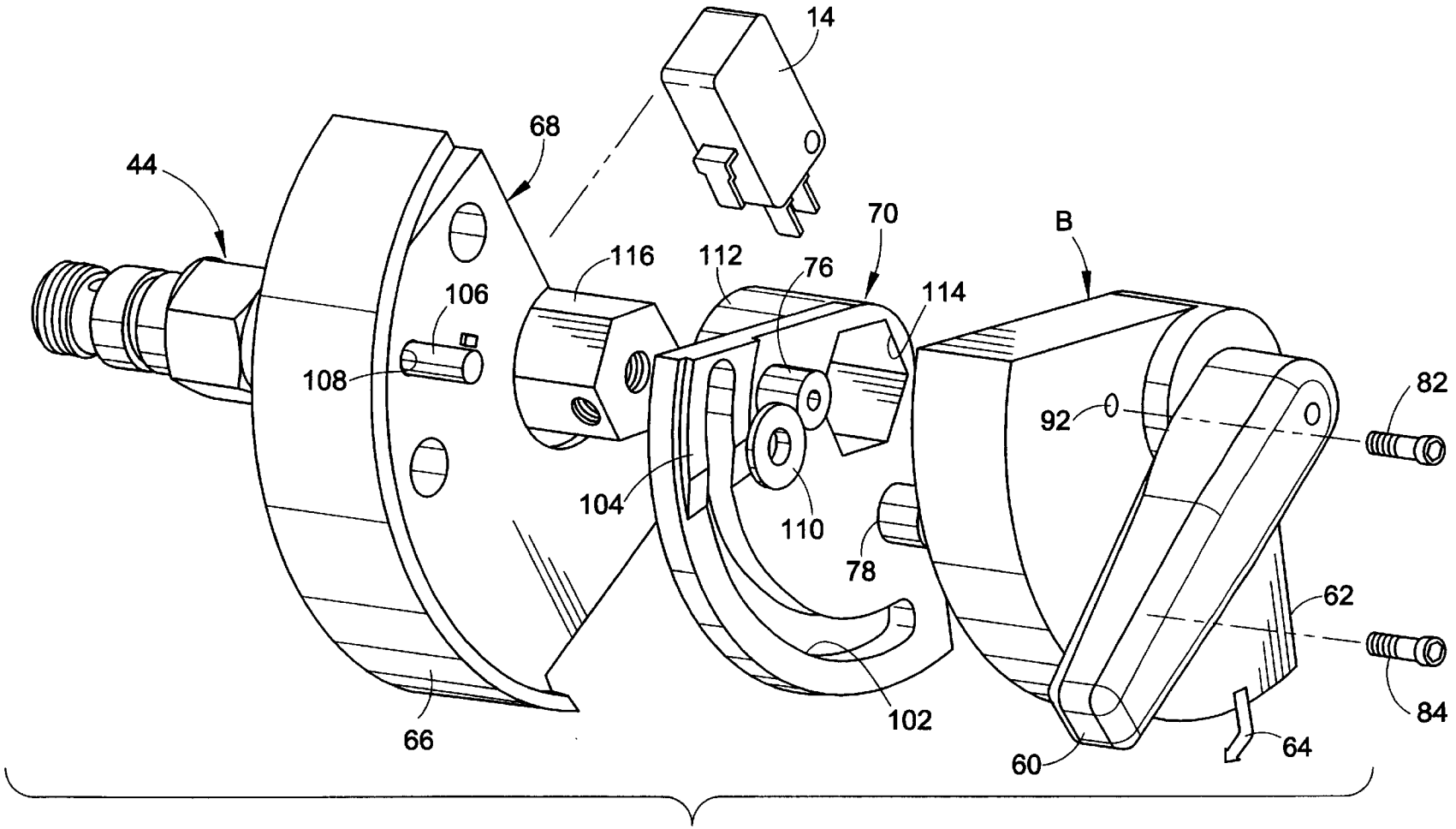
FIG. 5 is an exploded perspective illustration of a control in accordance with the present application.
Figure 6:
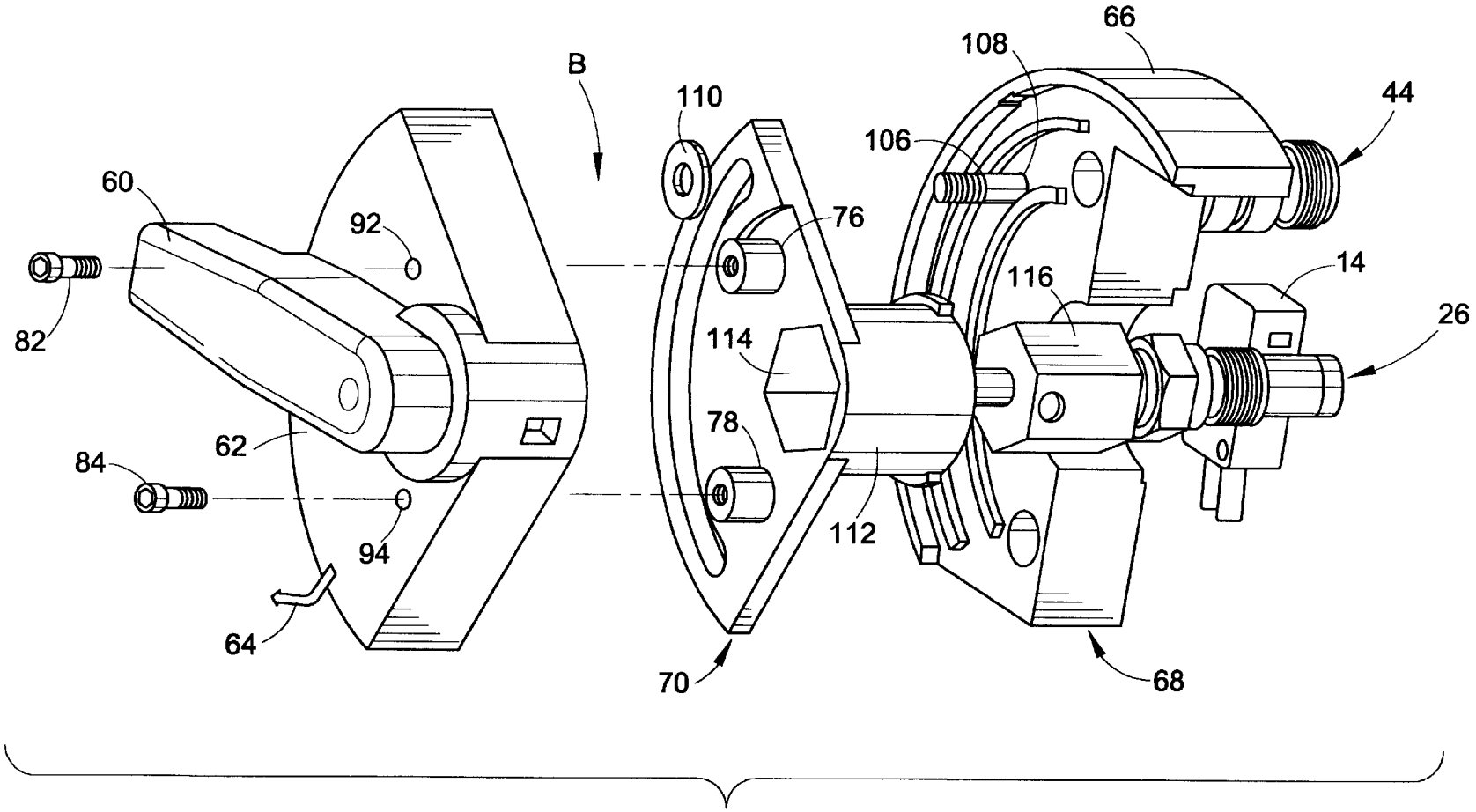
FIG. 6 is another exploded perspective illustration of the control.
Figure 7:
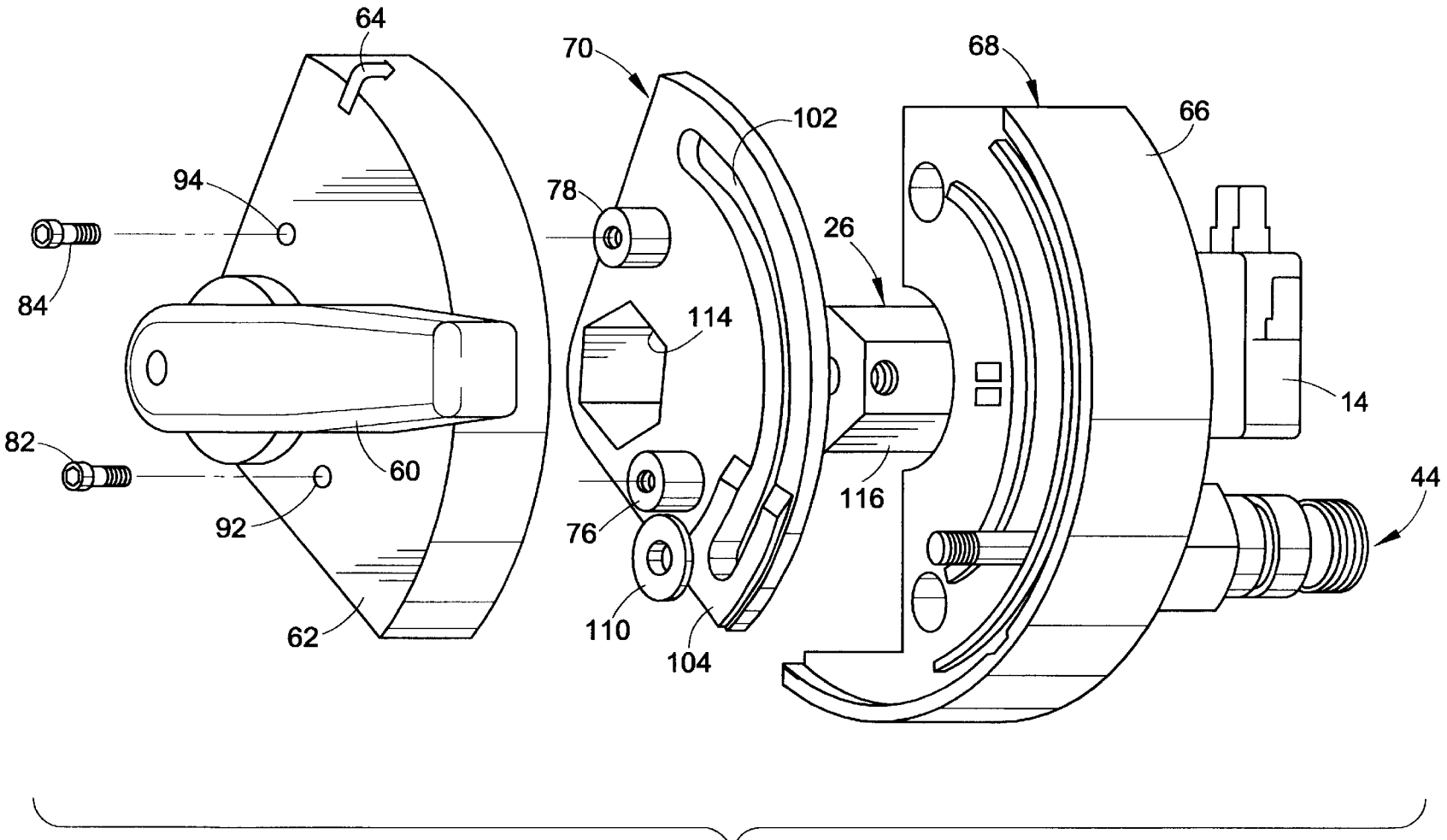
FIG. 7 is another exploded perspective illustration of the control.
Figure 8:
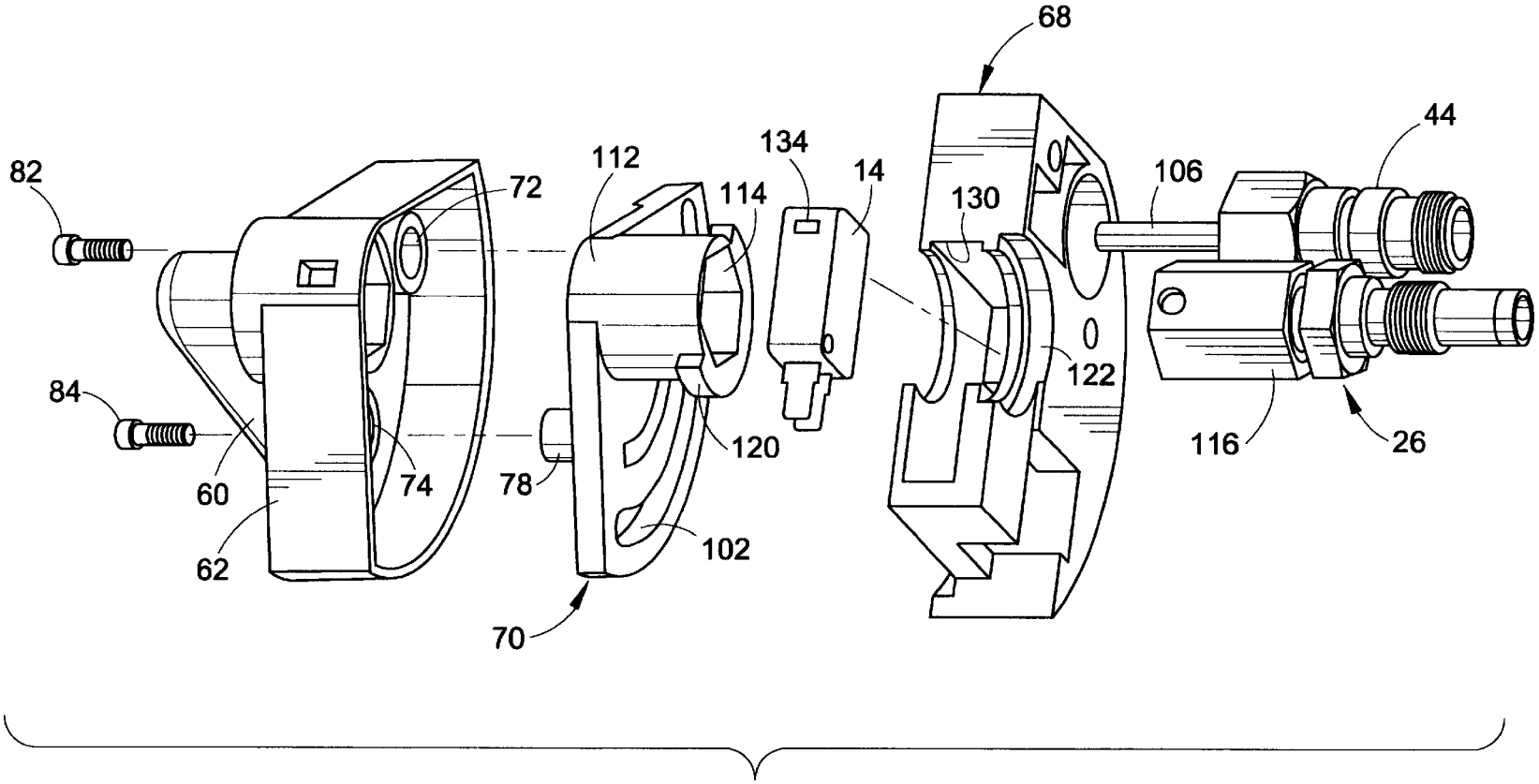
FIG. 8 is another exploded perspective illustration of the control.
Figure 9:
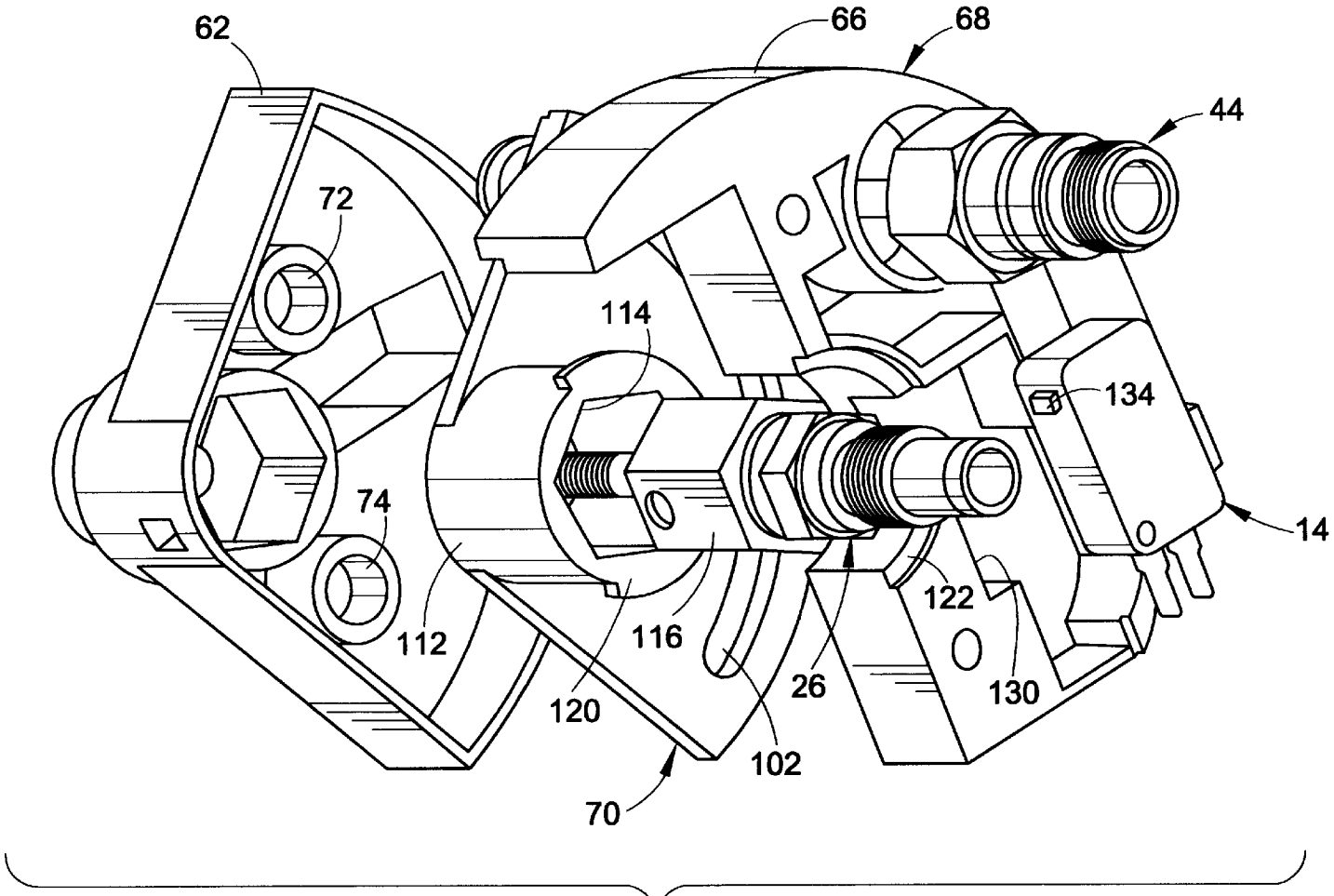
FIG. 9 is another exploded perspective illustration of the control.
Figure 10:
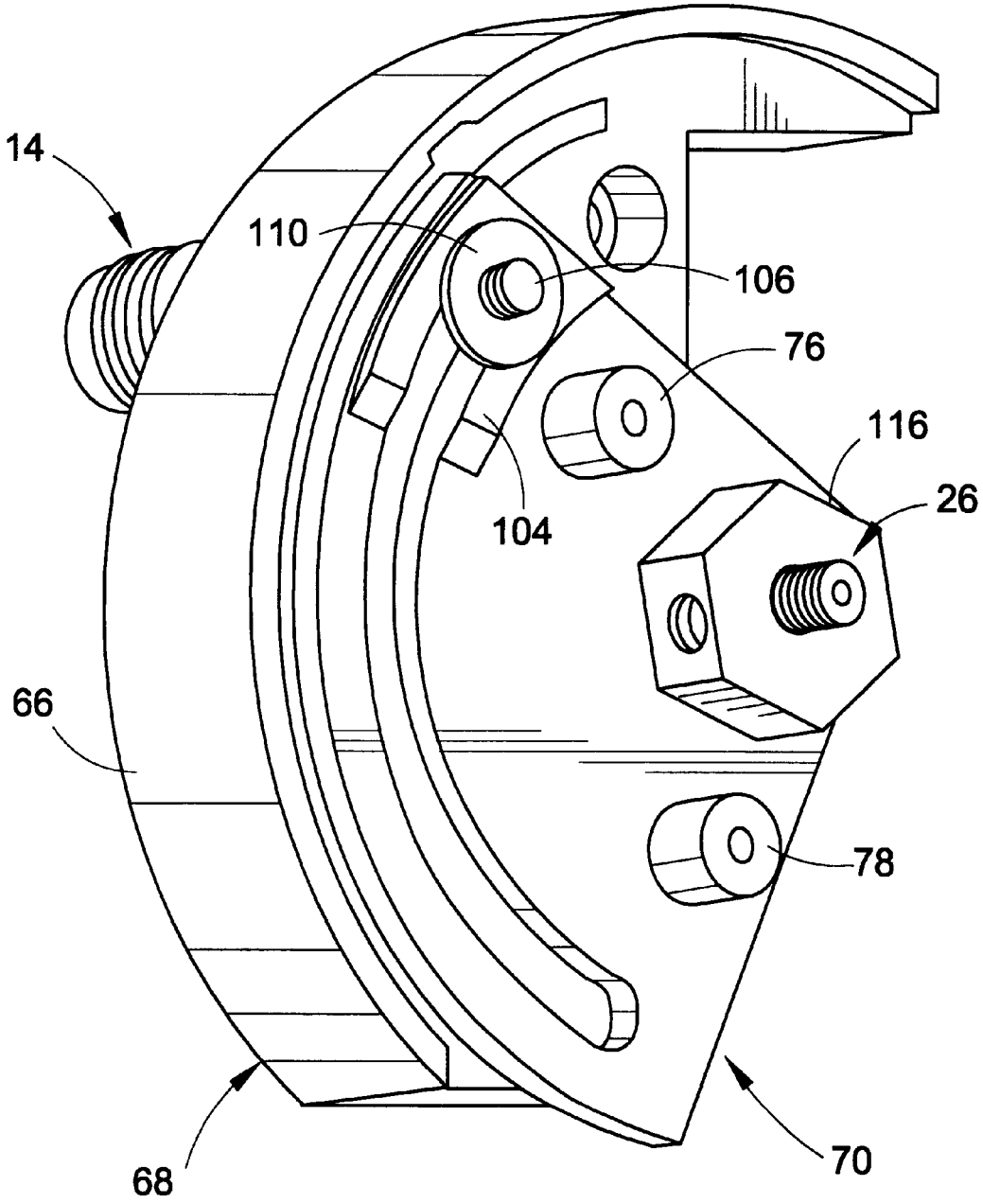
FIG. 10 is a perspective illustration of a control plate and a base member.
Figure 11:
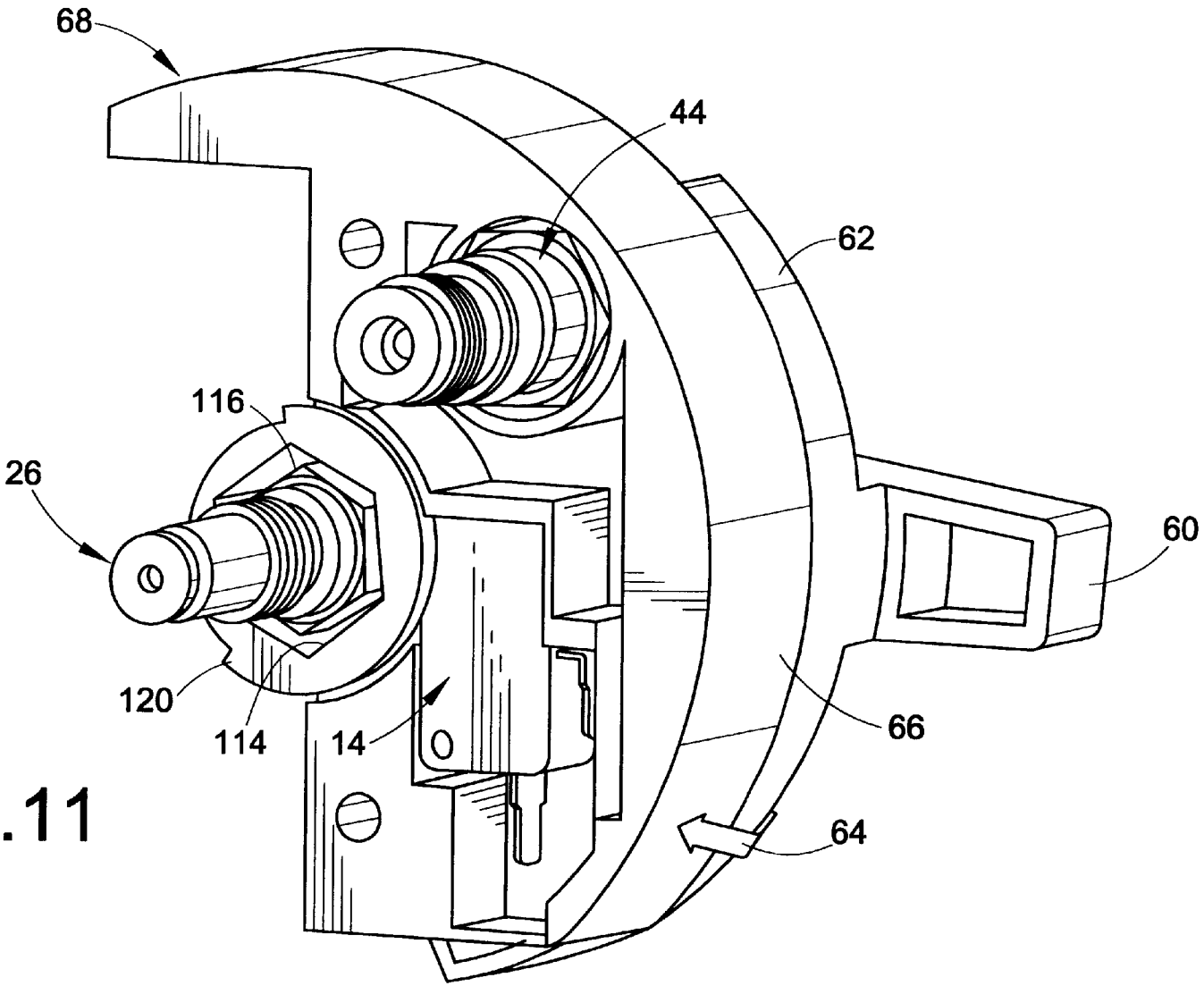
FIG. 11 is a perspective illustration of the rear of the base member.
Figure 12:
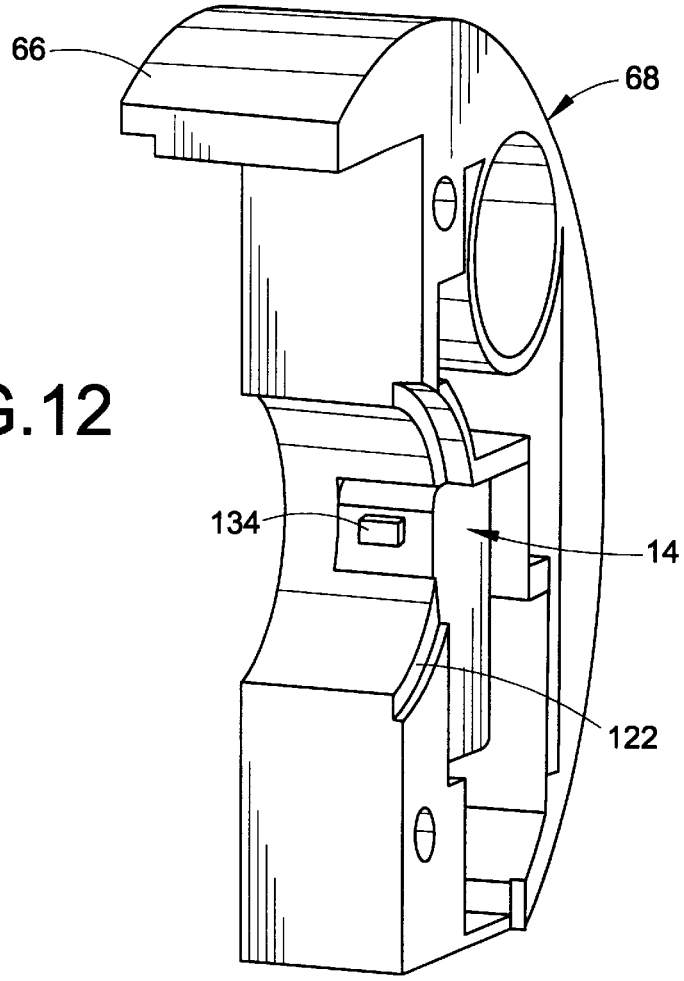
FIG. 12 is another perspective illustration of a base member.

FIGS. 2–4 show paint sprayer A as having a lower housing portion 50 enclosing the motor and an upper housing part 52 enclosing the other operating components. A paint inlet port 54 is supplied with paint through a paint inlet conduit 54*a* in FIG. 1. A paint outlet port 56 for supplying paint to spray gun 42 of FIG. 1 communicates therewith through a suitable conduit 56*a*. Bypass outlet port 58 communicates with paint bucket 36 through bypass outlet conduit 58*a* in FIG. 1 when bypass valve 44 is open to prime the unit or relieve pressure.

A single manually operable control B is provided for operating on/off switch 14, pressure adjusting valve 26 and bypass valve 44 of FIG. 1. Control B includes a manually graspable rotatable control knob or lever 60, and a control cover 62 that is rotatable with control knob 60 and has a pointer 64 thereon for cooperation with indicia on an arcuate flange 66 of a base member 68. Cooperation between pointer 64 and the indicia on arcuate flange 66 informs a user whether control B is in the on or off position, whether the bypass valve is open or closed, and the pressure setting.

Referring now to FIGS. 5–10 and 13, a control plate 70 is partly received within a recess in control cover 62 on the opposite side thereof from control knob 60. Cylindrical projections 72, 74 within control cover 62 receive projections 76, 78 on control plate 70. Plate projections 76, 78 have tapped bores therein for receiving screws 82, 84 that extend through suitable holes 92, 94 in control cover 62 that are centrally aligned with projections 72, 74, 76 and 78. This secures control cover 62 and control plate 70 together against relative movement therebetween.

An elongated arcuate slot 102 is provided in control plate 70, and a bypass valve cam 104 on the plate faces toward control cover 62 and straddles the slot adjacent one end of the plate. Bypass valve 44 has a bypass valve stem 106 projecting through a suitable hole 108 in base member 68. An end portion of bypass valve stem 106 extends through arcuate slot 102 in control plate 70 and receives a bypass valve cam follower 110 that cooperates with bypass cam 104 on control plate 70. A suitable nut or other fastener that is not shown is threaded on the end portion of bypass valve stem 106 to retain bypass valve cam follower 110 thereon.

Bypass valve stem 106 normally is biased in a direction from control plate 70 toward base member 68 to close bypass valve 44. Thus, when control plate 70 is rotated to positions where bypass valve cam follower 110 is disengaged from bypass cam 104, bypass valve cam follower 110 simply rides along or adjacent to the flat surface of control plate 70 on opposite sides of slot 102 and the bypass valve is closed. Upon rotation of control plate 70 in a counterclockwise direction, cam follower 110 rides up on cam 104 to pull valve stem 106 in an opposite direction to open bypass valve 44 and place same in the priming/pressure relieving position.

Control plate 70 has an elongated hub 112 extending therefrom toward base member 68. A non-circular opening 114 through hub 112 receives a correspondingly shaped rotatable adjusting member 116 on pressure adjusting valve 26. Non-circular opening 114 and rotatable adjusting member 116 may be hexagonal as shown, although it will be appreciated that other non-circular shapes may be used. Rotation of control knob 60, control cover 62 and control plate 70 also rotates adjusting member 16 to adjust the pressure at which pressure adjusting valve 26 opens.

Hub 112 on control plate 70 has an outwardly extending arcuate flange 120 on the end thereon receivable in an arcuate recess 122 in base member 68 for securing control knob 60, control cover 62 and control plate 70 against axial movement while allowing rotation thereof. Base member 68 has a cavity 130 therein receiving switch 14. A switch actuator 134 that may be termed a switch cam follower is provided for turning the switch on and off. Switch cam follower 134 faces toward and engages plate hub 112 having a switch cam 136 thereon.

Figure 13:
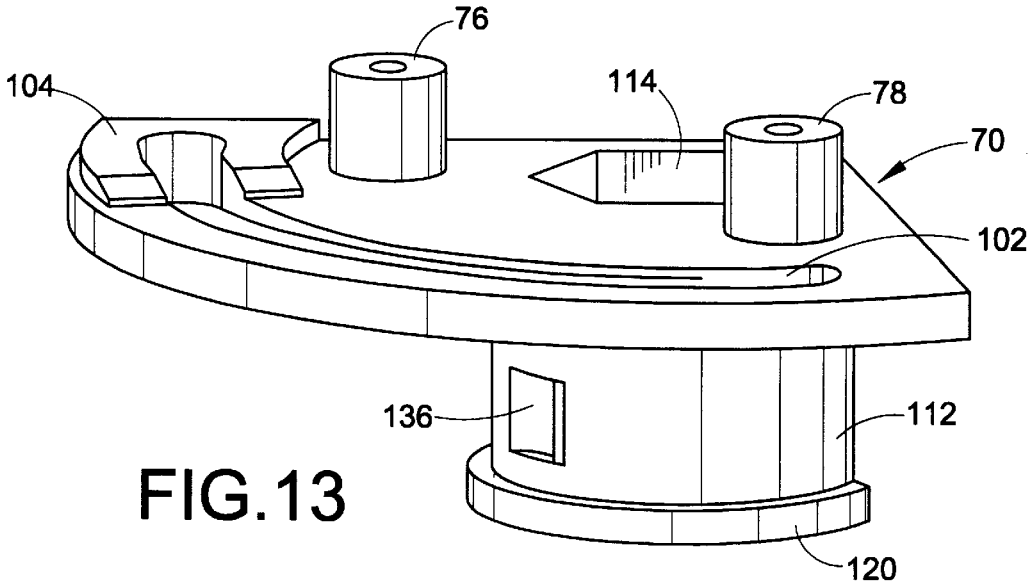
FIG. 13 is perspective illustration of the control plate.
Figure 15:
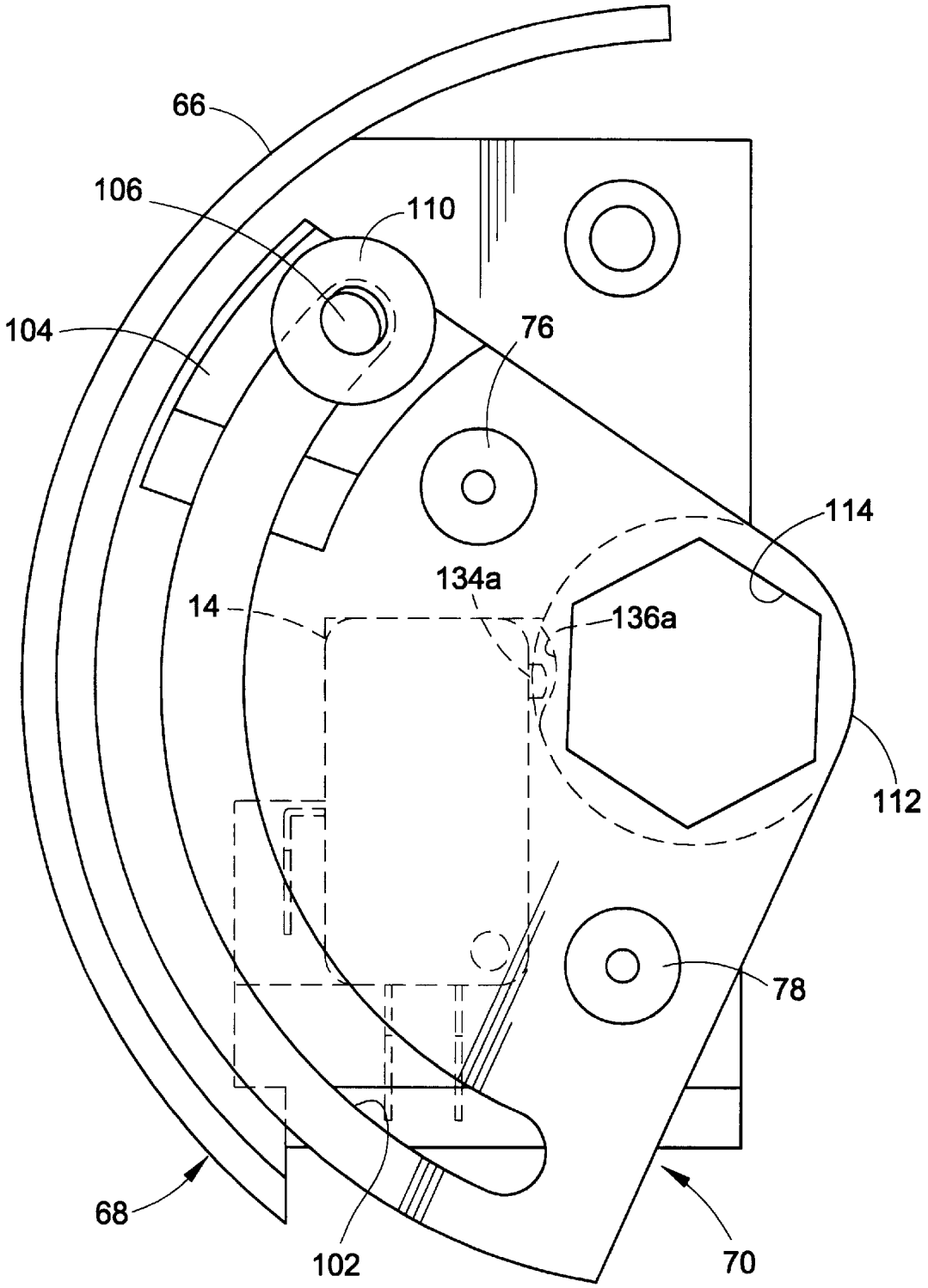
FIG. 15 is a view similar to FIG. 14 and showing another switch cam and switch cam follower arrangement.

In the arrangement of FIGS. 13 and 15, switch cam 136 is a switch recess and switch cam follower 134 normally is biased outwardly to an open position. Switch 14 is closed when switch cam follower 134 rides on the outer surface of plate hub 112 during rotation of control plate 70. When control plate 70 is rotated to a position wherein switch cam follower 134 is aligned with switch cam recess 136, switch cam follower 134 moves into cam recess 136 to open switch 14.

Figure 14:
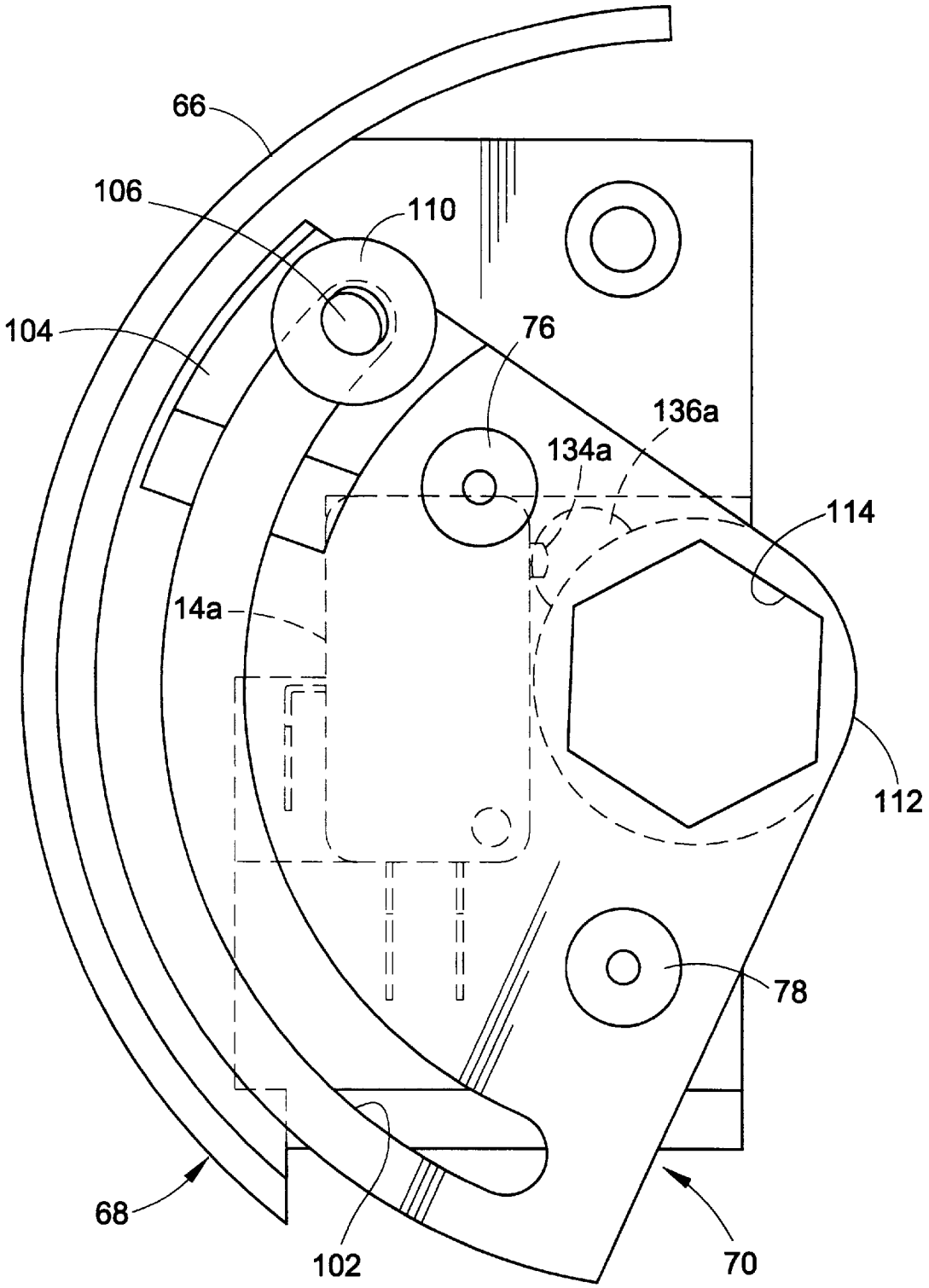
FIG. 14 is a partial cross-sectional elevational view showing a switch cam on the control and a switch cam follower on a switch.

In the arrangement of FIG. 14, switch cam follower 134*a* on switch 14*a* normally is biased outwardly to a closed position and moves inwardly in an opposite direction to an open position. Switch cam 136*a* on hub 112 is a sloping cam projection and switch 14*a* is closed when switch cam follower 134 rides on the cylindrical outer surface of hub 112. Switch cam 136*a* on hub 112 moves switch cam follower 134 in a direction away from hub 112 to open switch 14*a*.

Figure 17:
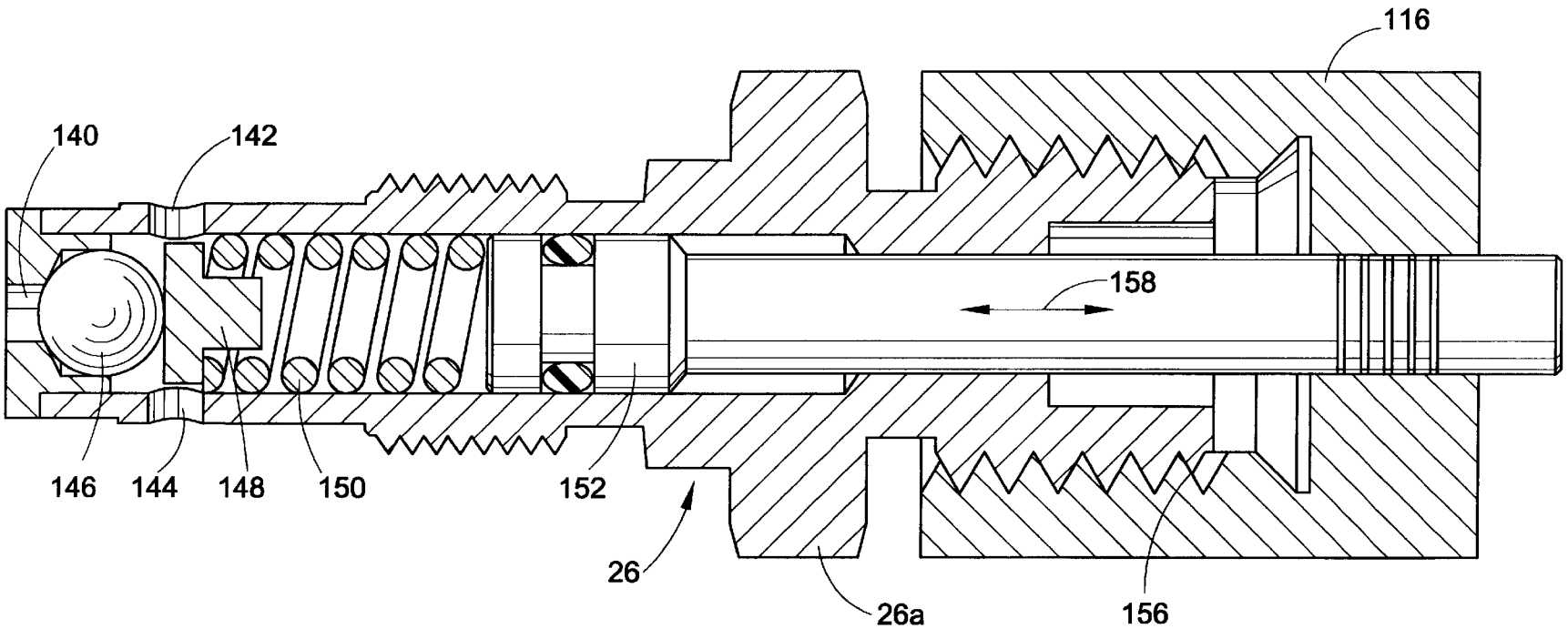
FIG. 17 is a side cross-sectional elevational view of a pressure adjusting valve.

Referring now to FIG. 17, pressure adjusting valve 26 has an inlet port 140 that provides an outlet from pump chamber 20 of FIG. 1, and outlet ports 142, 144 are suitably connected with hydraulic fluid reservoir 18 of FIG. 1. A ball 146 is biased in a direction to close inlet port 140 by a plunger 148 and a coil spring 150 that acts against the end of an adjustable rod 152.

Adjusting member 116 is attached to rod 152 against axial and rotational movement relative thereto so that the rod and adjusting member move in unison. Valve body 26*a* and adjusting member 116 have cooperating threads thereon as generally indicated at 156 so that rotation of adjusting member 116 relative to valve body 26*a* moves rod 152 to the right or to the left in FIG. 17 as generally indicated by arrows 158. Movement of rod 152 varies the force with which spring 150 acts on plunger 148 and ball 146 to vary the pressure at which ball 146 opens to allow hydraulic fluid to flow from pump chamber 20 of FIG. 1 back to reservoir 18. This regulates the pressure in pump chamber 20 as well as in paint pump chamber 32.

Counterclockwise rotation of adjusting member 116 moves rod 152 to the right in a direction away from ball 146 to reduce the biasing force of spring 150 and reduce the pressure required to open ball 146. This reduces the pressure in pump chamber 20 that acts on diaphragm 30 and thereby reduces the pressure produced in paint pump chamber 32. Clockwise rotation of adjusting member 116 moves rod 152 to the left in a direction toward ball 146 to increase the biasing force of spring 150 and increase the pressure required to open ball 146. This increases the pressure in pump chamber 20 that acts on diaphragm 30 and thereby increases the pressure produced in paint pump chamber 32.

In operation of the device, the single control provided by knob 60, control cover 62 and control plate 70 is rotated counterclockwise to one end limit position to turn the spraying device off. In the counterclockwise end limit position, switch cam 136 or 136*a* is cooperating with switch cam follower 134 or 134*a* to turn switch 14 or 14*a* off. In addition, bypass valve cam follower 110 is cooperating with bypass cam follower 104 on control plate 70 to open bypass valve 44 and relieve all pressure in the system.

Upon initial clockwise rotation of the control, switch cam follower 134 or 134*a* moves away from switch cam 136 or 136*a* and onto the cylindrical outer surface of hub 112 to turn switch 14 or 14*a* on. In this position of the control, bypass valve cam follower 110 remains in engagement with bypass valve cam 104 on control plate 70 so that bypass valve 44 remains in its open priming position and the pump operates to prime the unit. Further clockwise rotation of the control moves cam follower 110 off from bypass cam 104 and closes bypass valve 44 to provide paint under pressure to the spray gun.

Figure 16:
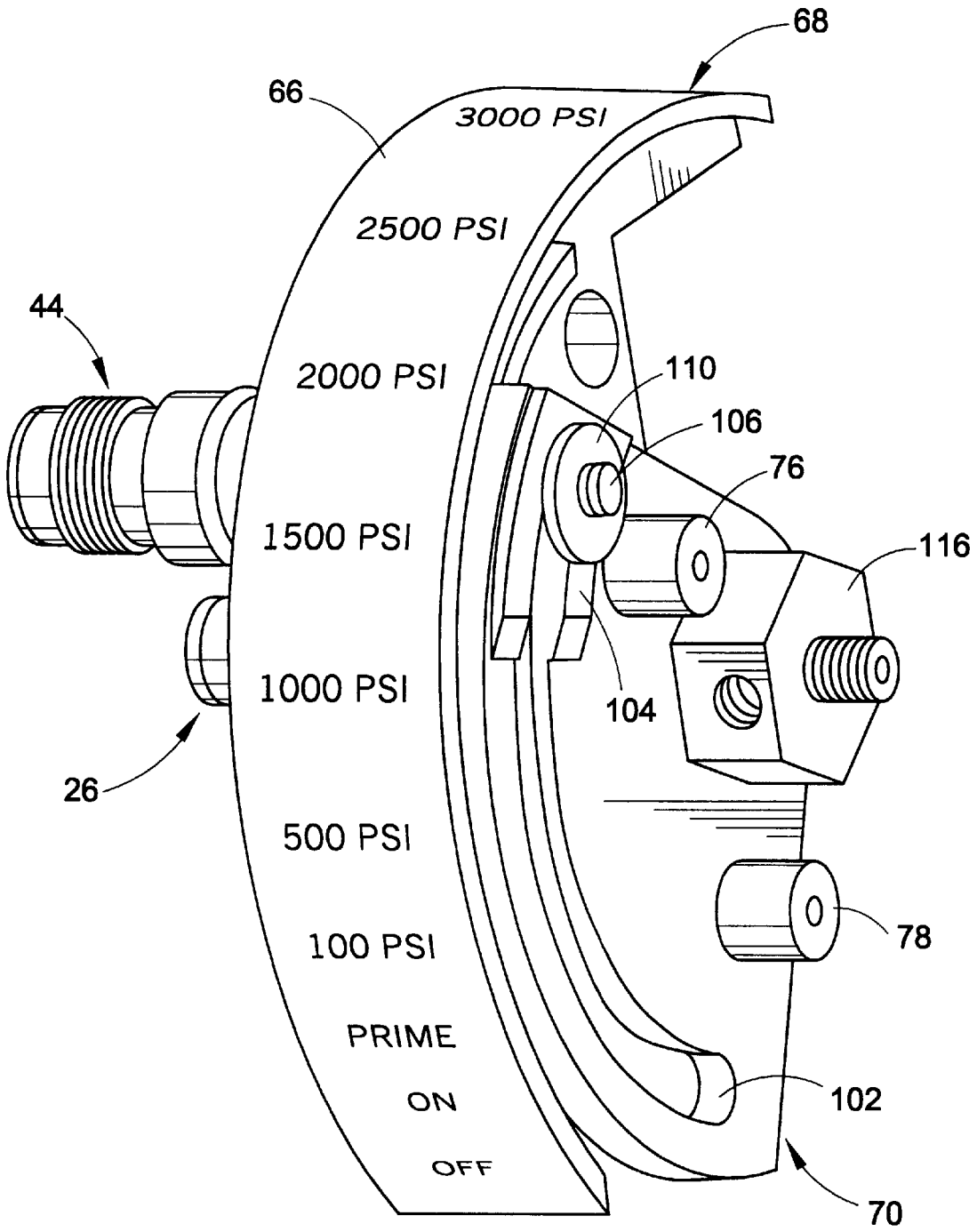
FIG. 16 is a perspective illustration of a base member and a control plate.

Clockwise rotation of the control provides adjustment of the pressure at which paint is supplied to the spray gun by adjusting pressure adjusting valve 26. FIG. 16 shows indicia on arcuate flange 66 on base member 68. The opposite end limit position of the control from the off position corresponds to the highest pressure and is shown as 3,000 psi. Obviously, the system may be arranged to operate over any desired practical pressure range. A user simply may align pointer 64 with the desired indicia on arcuate flange 66 to operate the spray device at a desirable pressure. When the unit is turned off by rotating the control counterclockwise, the bypass valve opens first by way of cooperation between bypass cam 104 on control plate 70 and bypass valve cam follower 110 on bypass valve stem 106. This relieves all pressure within the system, and further counterclockwise movement of the control to the one end limit position moves switch 14 or 14*a* to the off position. Thus, the single control automatically operates in the proper sequence both when it is moved in one direction to turn the sprayer on and when it is moved in an opposite direction to turn the sprayer off.

The single control of the present application moves through an angle of approximately 114° between its opposite end limits from the full off position to the highest pressure position. However, it will be recognized that the degree of movement may vary depending on the range of pressure adjustment desired or whether there is any pressure adjustment at all.

Although the disclosed arrangement provides for opening and closing of the bypass valve when the control is adjacent to its one end limit position in which the power switch is operated, it is obvious that the bypass valve can be operated in an alternative position of the control as well as in additional positions thereof. In the specific arrangement disclosed in the present application, the pressure is varied linearly by adjustment of the pressure adjusting valve as the control is moved between its opposite end limits. Obviously, the pressure can be varied non-linearly by arranging the mechanism to adjust the pressure adjusting valve non-linearly, and/or to provide a plurality of maximum and minimum pressure settings between the opposite end limit positions of the control.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. In a sprayer having an on/off switch, a bypass valve and a pressure adjusting valve, a single manually operable control that is selectively movable to a plurality of different positions to operate said on/off switch, said bypass valve and said pressure adjusting valve.

2. The sprayer of claim 1 wherein said control is movable in opposite directions between opposite end limits, said switch being off when said control is at one of said end limits and being on in all other positions of said control.

3. The sprayer of claim 2 wherein said pressure adjusting valve is at its highest pressure setting when said control is at the other of said end limits.

4. The sprayer of claim 2 wherein said control adjusts said pressure adjusting valve over a range of pressure adjusting positions during movement of said control between said opposite end limits.

5. The sprayer of claim 1 wherein said control operates a switch cam that turns said switch off in said one end limit position of said control and turns said switch on in all other positions of said control.

6. The sprayer of claim 5 wherein said switch cam is a switch cam recess and said switch has a cam follower that moves into said cam recess to turn said switch off and out of said cam recess to turn said switch on.

7. The sprayer of claim 6 wherein said bypass valve has open and closed positions and is in said open position when said control is in said one end limit position with said switch off.

8. The sprayer of claim 7 wherein said bypass valve remains open during initial movement of said control away from said one end limit position to turn said switch on and moves to said closed position upon further movement of said control away from said one end limit position to a range of pressure adjusting positions.

9. The sprayer of claim 1 wherein said control has a bypass cam and said bypass valve has a bypass cam follower, said bypass valve having open and closed positions, said bypass cam and said bypass cam follower being in cooperative engagement when said control is in a bypass valve open position and being out of engagement when said control is in a bypass valve closed position.

10. The sprayer of claim 1 wherein said control is rotatable in clockwise and counterclockwise directions to selectively operate said on/off switch, said bypass valve and said pressure adjusting valve.

11. The sprayer of claim 1 wherein said bypass valve has open and closed positions and said control includes a movable control plate having an elongated slot therein, said bypass valve having a bypass valve operator extending through said slot, a bypass valve cam on said control plate adjacent said slot, and a bypass cam follower on said bypass valve operator, said bypass cam and said bypass cam follower being in cooperative engagement when said bypass valve is in said open position and being out of engagement when said bypass valve is in said closed position.

12. The sprayer of claim 1 wherein said control is rotatable and said pressure adjusting valve includes a rotatable pressure adjusting member, said control being operable to rotate said pressure adjusting member over a range of different pressure settings when said switch is on and said bypass valve is closed.

13. The sprayer of claim 1 wherein said control has a bypass position wherein said bypass valve is closed, said control having a low pressure position adjacent to said bypass position wherein said bypass valve is closed and said pressure adjusting valve is at a low pressure setting, said control being movable away from said bypass position and said low pressure position to progressively adjust said pressure adjusting valve to increasingly higher pressure settings.

14. A sprayer having an on/off switch, a bypass valve and a pressure adjusting valve, a single manually rotatable control having a fixed axial position and being rotatable to different angular positions to selectively operate said on/off switch, said bypass valve and said pressure adjusting valve.

15. The sprayer of claim 14 wherein said switch has on and off positions and said control is rotatable between opposite end positions, said switch being in said off position when said control is in one of said end positions, and said switch being in said on position over the entire range of movement of said control between said one end position and the other of said end positions.

16. The sprayer of claim 15 wherein said bypass valve has open and closed positions and is in said open position when said control is in said one end position with said switch in said off position, said control having a bypass position adjacent to said one end position thereof in which said bypass valve is in said open position and said switch is in said on position, and said bypass valve being in said closed position over the entire range of movement of said control between said bypass position thereof and the other of said end positions thereof.

17. The sprayer of claim 16 wherein said control progressively adjusts said pressure adjusting valve to increasingly higher pressure settings during movement of said control from said bypass position to the other of said end positions.

18. A sprayer having an on/off switch, a bypass valve and a pressure adjusting valve, a single rotatable control that operates said switch, said bypass valve and said pressure adjusting valve, said control cooperating with said switch to turn said switch off in one end position of said control and to turn said switch on when said control is out of said one end position, said control cooperating with said bypass valve to open said bypass valve when said control is in said one end position and when said control is in a bypass position that is out of but adjacent to said one end position, said control cooperating with said bypass valve to close said bypass valve when said control is in a range of pressure adjusting positions between said bypass position and an opposite control end position, and said control cooperating with said pressure adjusting valve to progressively adjust said pressure adjusting valve to increasingly higher pressure settings during movement of said control from said bypass position thereof toward said opposite end position thereof.

19. The sprayer of claim 18 wherein said control includes a bypass cam and said bypass valve has a bypass cam follower, said bypass cam and said bypass cam follower cooperating to open said bypass valve when said knob is in said bypass position and in said one end position.

20. The sprayer of claim 19 wherein said control includes a control plate having an arcuate slot therein and said bypass valve has a bypass valve stem with a stem end portion extending through said slot, said bypass cam being adjacent to said slot, and said bypass cam follower being on said stem end portion.

21. The sprayer of claim 18 wherein said switch is normally open and includes a switch cam follower, said control having a switch cam and a switch cam recess thereon cooperating with said switch cam follower to close said switch when said switch cam and switch cam follower are in engagement and to open said switch when said switch cam follower is received in said switch cam recess.

22. The control of claim 18 wherein said switch is normally closed and includes a switch cam follower, said control having a switch cam thereon cooperating with said switch cam follower to open said switch in said one end position of said control.

* * * * *